US005423277A

United States Patent [19]

Gai

[11] Patent Number: 5,423,277

[45] Date of Patent: Jun. 13, 1995

[54] SAFETY DEVICE FOR HELM THROTTLE AND DIRECTIONAL CONTROLS OF WATER VEHICLES

[75] Inventor: Giorgio Gai, Genova, Italy

[73] Assignee: Ultraflex s.r.l., Genova, Italy

[21] Appl. No.: 272,815

[22] Filed: Jul. 11, 1994

Related U.S. Application Data

[63] Continuation-in-part of Ser. No. 694,939, May 2, 1991, Pat. No. 5,327,843.

[30] Foreign Application Priority Data

May 3, 1990 [IT] Italy ..... 12455 A/90

[51] Int. Cl.[6] ..... B63H 25/00

[52] U.S. Cl. ..... 114/144 R; 440/84; 440/87

[58] Field of Search ..... 114/144 R, 144 A, 146, 114/150; 440/84, 87, 53, 55, 61, 62, 64

[56] References Cited

U.S. PATENT DOCUMENTS 3,169,505 2/1965 Spraragen .
3,796,292 3/1974 Harrison .
4,106,426 8/1978 Wertz ..... 114/144 R
4,263,994 4/1981 Hayes ..... 114/144 R
4,495,881 1/1985 Teraura ..... 114/144 R
4,632,232 12/1986 Kolb et al. .
4,710,141 12/1987 Ferguson ..... 114/144 R
5,105,924 4/1992 Carlson .

FOREIGN PATENT DOCUMENTS 2709642 9/1978 Germany .
2927070 2/1980 Germany .
3432736 11/1985 Germany .
3819346 12/1989 Germany .

*Primary Examiner*—Jesus D. Sotelo

[57] ABSTRACT

In a helm, throttle and directional control system for small craft, a safety device arranged to operate between an actuating member and an actuated member has such members coupled rotatively together by means of mechanical one-way coupling devices wherein a resilient force holds the actuated member constantly biassed to a locked position, and wherein the locking action is released by moving the actuating member against the resilient force, thereby motion can be transferred to the actuated member from the actuating member.

16 Claims, 5 Drawing Sheets

SAFETY DEVICE FOR HELM THROTTLE AND DIRECTIONAL CONTROLS OF WATER VEHICLES

BACKGROUND OF THE INVENTION

This application is a continuation-in-part of U.S. Ser. No. 07/694,939 filed May 2, 1991 now U.S. Pat. No. 5,327,843.

FIELD OF THE INVENTION

This invention relates to helm, throttle and directional controls for small craft such as outboard, inboard, and inboard/outboard powered boats and similar water vehicles. More specifically, the present invention concerns a safety device which fits between an actuating member and an actuated member in helm, throttle and directional controls.

The actuating member may be a control drive shaft connected to the steering wheel of a boat, and the actuated member may be a driven shaft coupled to a control cable for the boat's steering device.

The actuating member may also be a control drive shaft connected to a throttle control lever and/or a reverse control lever for the boat's powerplant, and the actuated member may be a driven shaft coupled to a throttle control cable and/or a reverse gear control cable.

Description of Related Art

In connection with helm controls, it is a basic requirement that undesired and unintentional changes in the setting of the steering device should be prevented, especially for safety reasons. In fact, should the helmsman fall accidentally overboard, the water flow around the steering device is liable to act such that the steering device left to itself swings into an ever tighter turn, whereby the boat will circle around the man in the water on a closing spiral course and become a positive hazard.

Powerplant controls also require that no undesired change be applied fortuitously to any pre-selected settings.

A most widely employed method of preventing undesired and fortuitous changes to the setting of the actuated member has been that of braking the rotational movement of the actuating member such as by means of a slip clutch between the actuating and actuated members. However, this tends to make the actuating-member stiffer and tiring to operate, and in any event cannot provide failsafe unalterability of the setting where, for example, the forces acting on the actuated member are large ones.

SUMMARY OF THE INVENTION

Therefore, it is the object of this invention to provide a safety device for small craft helm, throttle and directional controls which can fulfill the above-specified demands.

This object is achieved by a safety device for small craft helm, throttle and directional controls, intended for operation between an actuating member and an actuated member of the helm, throttle and directional controls, characterized in that the actuating and actuated members are coupled rotatively together through a one-way mechanical coupling means wherein a resilient force holds the actuated member constantly in a locked position, and release is accomplished automatically by moving the actuating member against said resilient force to transfer motion to the actuated member from the actuating member.

BRIEF DESCRIPTION OF THE DRAWINGS

For a clearer understanding of the features and advantages of this invention, some embodiments thereof will be described hereinafter with reference to the accompanying drawings, wherein.

DETAILED DESCRIPTION OF PREFERRED EMBODIMENTS

The safety device of this invention will be first described as applied to a steering wheel type of helm for a water vehicle with reference to FIGS. 1 through 8 of the drawings.

Figure 1:
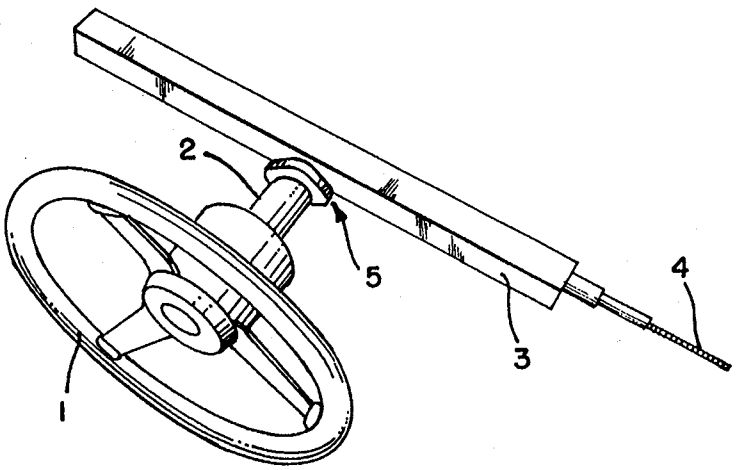
FIG. 1 is a perspective view of a steering wheel and associated helm box for the control cable in the steering system of a water vehicle.

With specific reference to FIG. 1, shown at 1 is the steering wheel of the helm of a water vehicle, e.g. a motor boat. The steering wheel drive shaft 2 penetrates a box 3 accommodating a unit whereby the helm control cable 4 can be operated. Of course, this cable control unit may be any suitable type to convert the rotary movement of the steering wheel 1 into a linear movement of the cable 4, and may either be of the rack-and-pinion, or chain-and-sprocket, or other comparable types. The safety device of this invention is interposed between the shaft 2 and the input end of the cable 4 of the control unit.

A first embodiment of the safety device according to the invention will be now described with reference to FIGS. 2A, 3A, and 4A.

Shown at 5 in these drawing figures is a stationary pin, which may be affixed to the bottom of the box 3, for example. Tightly wound around this pin 5 is a rectangular coil spring 6*a* having its ends 106*a* and 206*a* bent to project radially outwards, from diametrically opposite positions of the spring, as shown best in FIG. 4A. That end of the shaft 2 which extends into the box 3 is shaped as a half-cup 7*a*, so as to embrace the pin 5 and the spring 6*a* wound thereon with some radial and axial clearance, and extends circumferentially around the pin 5 through an angle of (for example) 180°-2alpha, as shown best in FIG. 4A. The radius for the half-cup shape 7*a* should be such that the latter engages, as the shaft 2 is rotated, with ends 106*a* and 206*a*, respectively, of the spring 6*a*, for purposes to be explained. Further, in all embodiments the value 180°-2alpha is determined according to size and positioning of at least one of several elements including elements 9*a*–7*a* and spring ends 106*a* and 206*a*. Thus 180°-2alpha is not limitative.

The half-cup 7*a* is also formed, at the base thereof where it does not interfere with said ends of the spring 6*a*, with two teeth or dogs 107, 207 which extend circumferentially and symmetrically from either side through angle alpha, whereby the half-cup shape will extend through 180° at the location of the teeth.

Reference numeral 8 is the driven shaft for operating the steering arrangement. In the embodiment shown, this driven shaft 8 is a tubular shaft mounted for free rotation on the shaft 2 concentrically therewith. The driven shaft 8 is terminated with a half-cup shape 9*a* having the same radius as the shape 7*a* and extending around the pin 5 through an angle of 180°-2alpha. Keyed on the other end of driven shaft 8 is a pinion gear 10 which may either mesh directly with the cable 4 in helical form as shown in FIG. 3A, or with a rack connected to the cable 4.

Shaft 2 forms the actuating member for the helm system shown and shaft 8 its actuated member.

The device just described operates as follows.

Figure 2A:
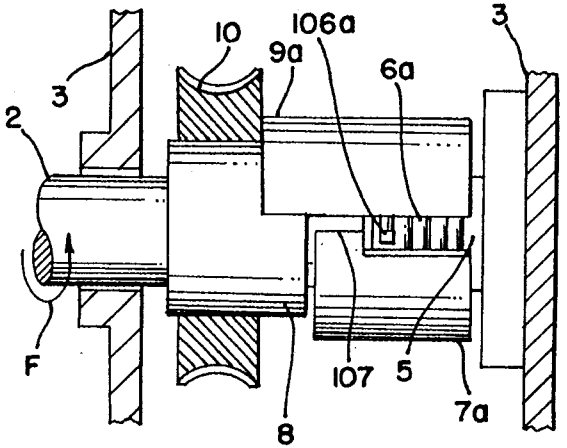
FIG. 2A shows a first embodiment of the safety device according to the invention.
Figure 4A:
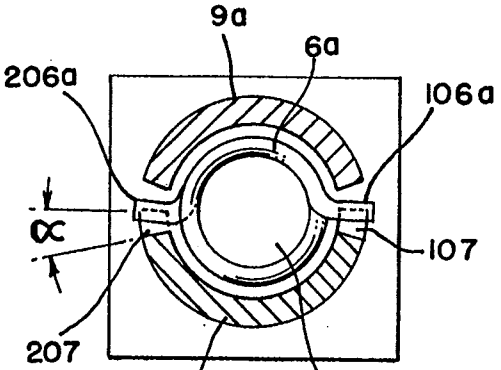
FIG. 4A is a cross-sectional view taken along the line 4A—4A in FIG. 3A.

Making reference in particular to FIGS. 1, 2A, and 4A, it will be assumed that the steering wheel 1 is turned in the counterclockwise direction, for example, as indicated by an arrow F in FIG. 2A.

The half-cup shape 7*a* will be turned accordingly in that direction through the shaft 2 of the wheel 1. During a first fractional rotation, through the angle alpha in FIG. 4A, shape 7*a* will abut against a planar surface of the end 106*a* of the rectangular spring 6*a* and urge it in the opposite direction from the winding direction of the spring 6*a* around the pin 5. This results in the winding of spring 6*a* being expanded, with consequent attenuation or removal of the frictional engagement between the spring 6*a* and the pin 5, whereby the spring 6*a* can be entrained to rotate with the shaft 2 of the steering wheel 1.

Concurrently therewith, as shown in FIG. 2A the tooth 107 on the shape 7*a* will come to bear on the shape 9*a* unitary with shaft 8, so that shaft 8 is also entrained rotatively by the steering wheel shaft 2, to therefore rotate the pinion gear 10 operating the helm control cable 4.

It has been found that use of a rectangular spring of, for example, a square cross-section applies a uniformly even tension against a shape to which it is applied, particularly an opposing planar surface as presented by shape 9*a*. A similar phenomenon occurs at the other end 206*a* of the spring 6*a* as described further hereinbelow. In other words, although the prior device using a cylindrical coil spring as described in parent application Ser. No. 07/694,939 operates exceptionally well, over extended periods of time, the circular shape of the spring end may wear a groove in shape 7*a* or 9*a* resulting in "play" of the steering system. Because of the uniformity of mating surfaces when using a planar spring pushing surface, the formation of a groove in either of shapes 7*a* or 9*a* does not occur. It has been further discovered that use of such a spring results in less force required to operate the steering system due to the broad surface contact of the planar surfaces as opposed to a "point" type of contact which occurs with the end of a cylindrical coil spring heretofore used.

Testing of the instant device with the use of a rectangular coil spring at a load of 407 Kg in push and pull at about 20 cycles per minute resulted in up to 300,000 turning cycles of the steering mechanism without spring breakage.

It should be understood that although a rectangular coil spring is disclosed and shown, any coil spring having two opposing parallel planar surfaces would be acceptable for use as long as the planar surfaces are positioned to engage with shapes 7*a* or 9*a* as shown.

Because of the effectiveness of the rectangular shaped coil spring, it is also possible to eliminate use of dogs or teeth 107, 207, simply allowing opposing shape 7*b* or 9*b* to act in a reverse direction on an opposing planar surface of the spring 6*b* than that which is acted on initially as shown and described below in connection with FIGS. 2B, 3B and 4B. In other words, shapes 7*b* and 9*b* may function as bidirectional actuators against opposing surfaces of the ends 106*b*, 206*b* of the rectangular coil spring 6*b*.

Figure 3A:
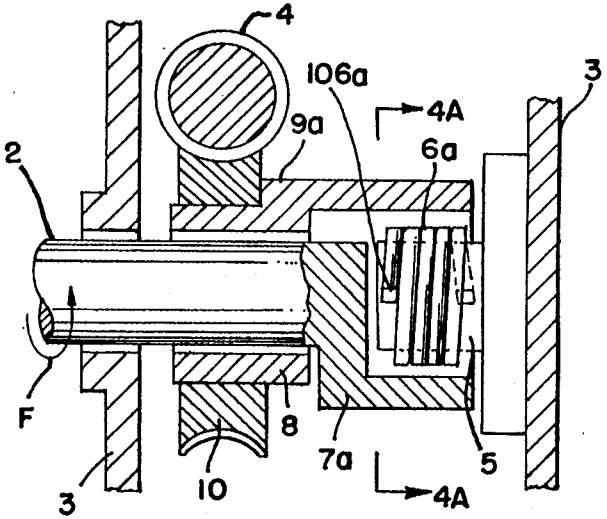
FIG. 3A is a view of the safety device in FIG. 2A with parts shown in longitudinal section.

Returning again to the discussion of the first embodiment, a similar effect would occur as the steering wheel 1 is turned clockwise in FIGS. 2A, 3A and 4A. Shape 7*a* engages here the opposite end 206*a* of the spring 6*a*, and the tooth 207 on shape 7*a* comes to bear on shape 9. Upon releasing the steering wheel, the spring 6*a* will resume its original condition of close adhesion to the pin 5. At this stage, a tensile force applied to the cable 4 from the steering device of the water vehicle will cause one edge of shape 9*a* to strike one end, 106*a* or 206*a*, of the spring 6*a* along the winding direction of the spring around the pin 5, whereby the spring 6 will be locked onto the pin 5 by the strong frictional resistance and stop the movement of shape 9*a*, so that the steering device cannot swing out of the setting imparted immediately prior to releasing the steering wheel. It should be emphasized that the action of shape 9*a* on the spring 6*a* tends to enhance the frictional engagement with the pin 5.

A second embodiment of the safety device according to the invention will be now described with reference to FIGS. 2B, 3B, and 4B.

Figure 2B:
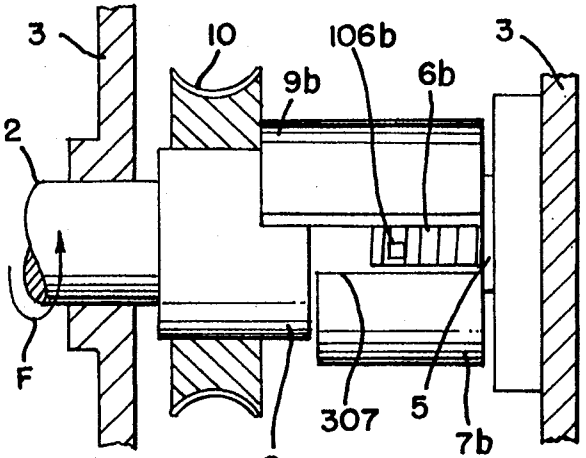
FIG. 2B shows a second embodiment of the safety device according to the invention.

As described briefly above and shown in FIG. 2B, an opposing side of the rectangular spring end 106*b* will urge directly against the shape 9 thereby eliminating use of the tooth 107*a* of FIG. 2A.

Shown at 5 in these drawing figures is a stationary pin, which may be affixed to the bottom of the box 3, for example. Tightly wound around this pin 5 is a rectangular coil spring 6*b* having its ends 106*b* and 206*b* bent to project radially outwards, from diametrically opposite positions of the spring, as shown best in FIG. 4B. That end of the shaft 2 which extends into the box 3 is shaped as a half-cup 7b, so as to embrace the pin 5 and the spring 6b wound thereon with some radial and axial clearance, and extends circumferentially around the pin 5 through an angle of (for example) 180°-2alpha, as shown best in FIG. 4B with alpha being measured from a contact surface of half-cup 7b to a center line of spring ends 106b, 206b. The radius for the half-cup shape 7b should be such that the latter engages, as the shaft 2 is rotated, with ends 106b and 206b, respectively, of the spring 6b, for purposes to be explained. Further, in these embodiments, the value 180°-2alpha is determined according to size and positioning of at least one of several elements including elements 9b–7b and spring ends 106b and 206b. Thus, 180°-2alpha is not limitative.

The half-cup 7b includes an uninterrupted surface 307 as best shown in FIG. 2B which engages in complete surface contact with corresponding planar surfaces of the ends 106b, 206b of the rectangular coil spring 6b.

Reference numeral 8 is again the driven shaft for operating the steering arrangement. In the embodiment shown, this driven shaft 8 is a tubular shaft mounted for free rotation on the shaft 2 concentrically therewith. The driven shaft 8 is terminated with a half-cup shape 9b having the same radius as the shape 7b and extending around the pin 5 through an angle of 180°-2alpha. Keyed on the other end of driven shaft 8 is a pinion gear 10 which may either mesh directly with the cable 4 in helical form as shown in FIG. 3B, or with a rack connected to the cable 4.

Shaft 2 forms the actuating member for the helm system shown and shaft 8 its actuated member.

The device just described operates as follows.

Figure 4B:
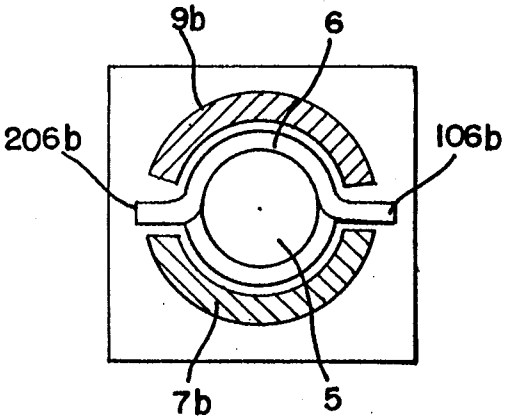
FIG. 4B is a cross-sectional view taken along the line 4B—4B in FIG. 3B.

Making reference in particular to FIGS. 1, 2B, and 4B, it will be assumed that the steering wheel 1 is turned in the counterclockwise direction, for example, as indicated by an arrow F in FIG. 2B.

The half-cup shape 7b will be turned accordingly in that direction through the shaft 2 of the wheel 1. During a first fractional rotation, through the angle alpha in FIG. 4B, shape 7b will abut against a planar surface of the end 106b of the rectangular spring 6b and urge it in the opposite direction from the winding direction of the spring 6b around the pin 5. This results in the winding of spring 6b being expanded, with consequent attenuation or removal of the frictional engagement between the spring 6b and the pin 5, whereby the spring 6b can be entrained to rotate with the shaft 2 of the steering wheel 1.

Concurrently therewith, as shown in FIG. 2B an opposing planar surface of spring 106b will come to bear on the shape 9b unitary with shaft 8, so that shaft 8 is also entrained rotatively by the steering wheel shaft 2, to therefore rotate the pinion gear 10 operating the helm control cable 4.

Testing of the instant device with the use of a rectangular spring again resulted in up to 300,000 turning cycles of the steering mechanism without spring breakage.

It should be understood that although a rectangular coil spring is disclosed and shown, any coil spring having two opposing parallel planar surfaces would be acceptable for use as long as the opposing planar surfaces of spring 106b are positioned to engage in planar surface contact with shapes 7b or 9b.

Because of the effectiveness of the rectangular shaped coil spring, it is therefore possible to eliminate use of dogs or teeth 107, 207, simply allowing opposing shape 7b or 9b to act in a reverse direction on an opposing planar surface of the spring 6b than that which is acted on initially. In other words, shapes 7b and 9b may function as bidirectional actuators against opposing surfaces of the ends 106b, 206b of the rectangular coil spring 6b.

Figure 3B:
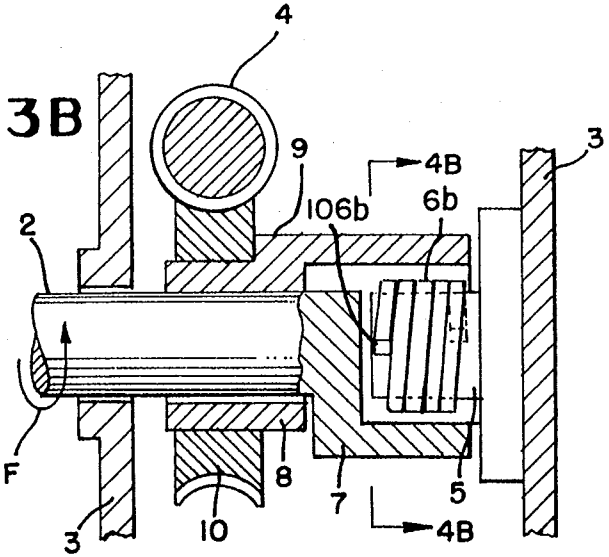
FIG. 3B is a view of the safety device in FIG. 2B with parts shown in longitudinal section.

A similar effect would occur as the steering wheel 1 is turned clockwise in FIGS. 2B, 3B and 4B. Shape 7b engages here the opposite end 206b of the spring 6b, and the opposing surface of spring end 206b comes to bear on shape 9b. Upon releasing the steering wheel, the spring 6b will resume its original condition of close adhesion to the pin 5. At this stage, a tensile force applied to the cable 4 from the steering device of the water vehicle will cause one edge of shape 9b to strike one end, 106b or 206b, of the spring 6b along the winding direction of the spring around the pin 5, whereby the spring 6b will be locked onto the pin 5 by the strong frictional resistance and stop the movement of shape 9b, so that the steering device cannot swing out of the setting imparted immediately prior to releasing the steering wheel. It should be emphasized that the action of shape 9b on the spring 6b tends to enhance the frictional engagement with the pin 5.

Figure 6B:
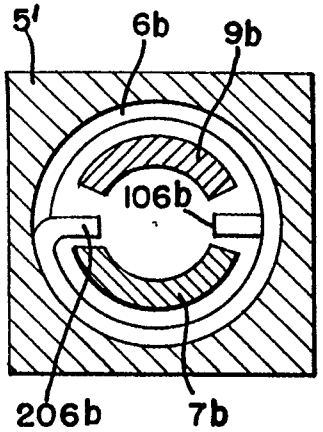
FIG. 6B is a cross-sectional view taken along the line 6B—6B in FIG. 5B.
Figure 5B:
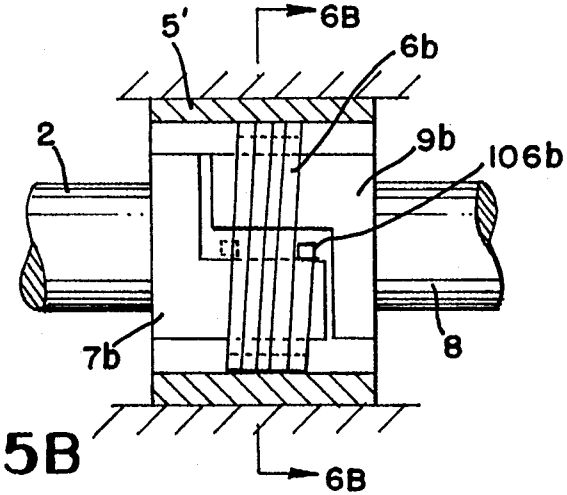
FIG. 5B shows a fourth embodiment of the safety device according to the invention with parts shown in longitudinal section.
Figure 6A:
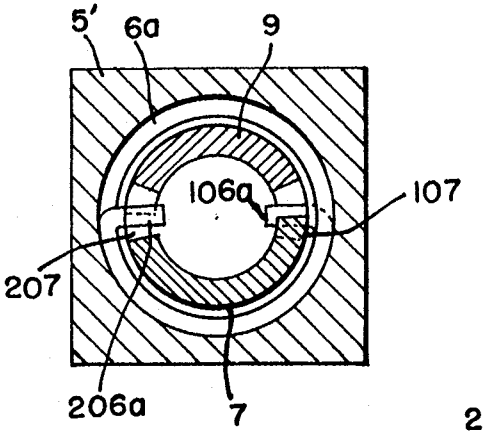
FIG. 6A is a cross-sectional view taken along the line 6A—6A in FIG. 5A.
Figure 5A:
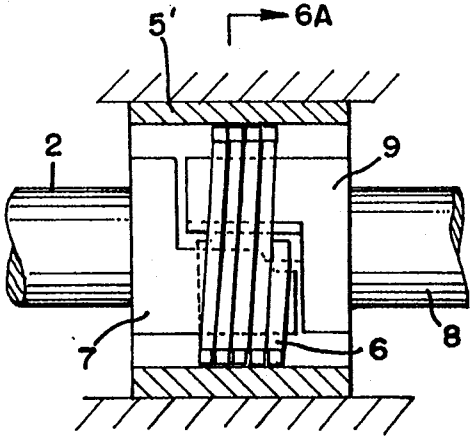
FIG. 5A shows a third embodiment of the safety device according to the invention with parts shown in longitudinal section.

FIGS. 5A and 6A show a device quite similar to that in FIGS. 2A, 3A, and 4A, and similar corresponding parts of this device will be referenced, therefore, as in the previously described embodiment.

With reference to the drawing figures, the spring 6a is disposed with radial clearance around the two half-cup shapes 7a and 9a, respectively unitary with the drive shaft 2 and the driven shaft 8, and is urged against the concentrical bush 5' affixed to the helm box 3 in any suitable manner.

The ends 106a, 206a of the spring 6a are bent radially inwards so as to intervene between the half-cup shapes 7a and 9a.

The operation of the safety device is here quite the equivalent for all the rest of that of the safety device embodied in FIGS. 2A, 3A, and 4A, it being understood that in this case the spring 6a will interact by frictional engagement with the bush 5'.

FIGS. 5B and 6B show a device quite similar to that in FIGS. 2B, 3B, and 4B, and similar corresponding parts of this device will be referenced, therefore, as in the previously described embodiment.

With reference to the drawing figures, the spring 6b is disposed with radial clearance around the two half-cup shapes 7b and 9b, respectively unitary with the drive shaft 2 and the driven shaft 8, and is urged against the concentrical bush 5' affixed to the helm box 3 in any suitable manner.

The ends 106b, 206b of the spring 6b are bent radially inwards so as to intervene between the half-cup shapes 7b and 9b.

The operation of the safety device is here quite the equivalent for all the rest of that of the safety device embodied in FIGS. 2B, 3B, and 4B, it being understood that in this case the spring 6b will interact by frictional engagement with the bush 5'.

Figure 7:
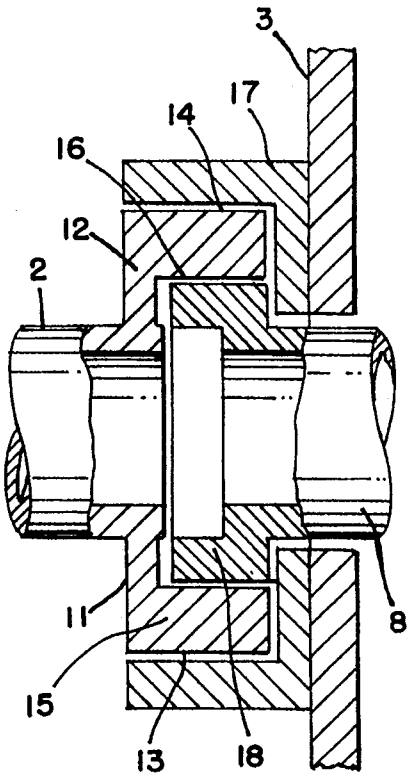
FIG. 7 is a longitudinal section view of a fifth embodiment of the inventive safety device.
Figure 8:
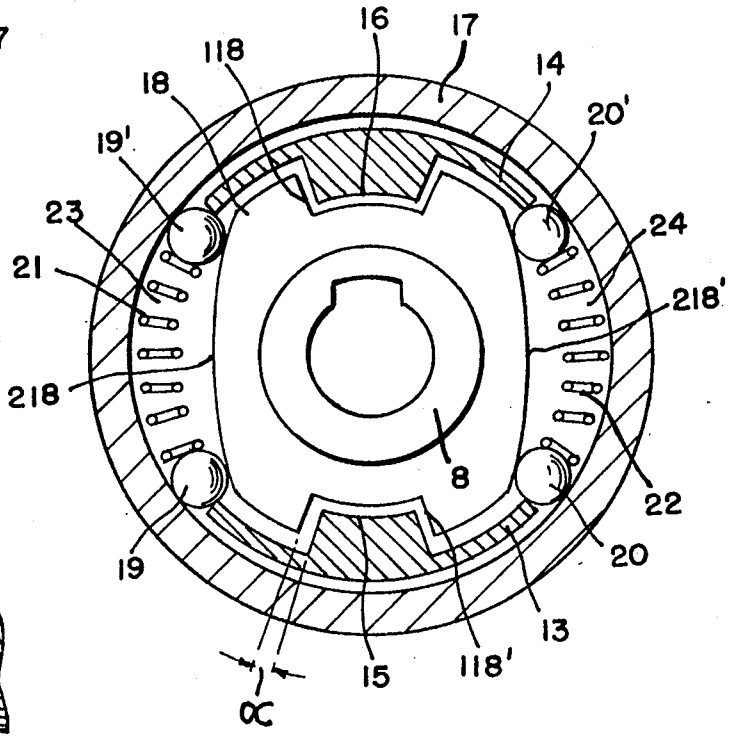
FIG. 8 is a cross-sectional view through the safety device shown in FIG. 7.

FIGS. 7 and 8 show a further embodiment of the safety device according to the invention.

With reference to these drawings, indicated at 2 is the drive shaft. This shaft is terminated with two radial arms 11 and 12 projecting from radially opposite positions. Connected to those arms 11 and 12 are two cylinder segment elements 13 and 14 which extend over an arc of about 90° and are each provided with a tooth or dog 15 and 16, respectively, centrally thereon, the teeth or dogs extending radially toward the center. The two segments 13 and 14 are accommodated inside a cylindrical case 17 attached to the box 3 in a freely rotatable manner with a small radial clearance. Located within the case 17, between the segments 13 and 14, is an element 18 connected to the drive shaft 8.

This element 18 is formed, at diametrically opposite locations thereon, with two notches 118,118' engaging the teeth 15 and 16 with a backlash 2alpha. It also has, at diametrically opposite locations orthogonal to the notches 118, 118' two substantially straight surfaces 218, 218'. Two spaces 23 and 24, bound by the surfaces 218, 218', the inner wall of the cylindrical case 17, and the ends of the cylinder segments 13 and 14, accommodate two ball pairs 19, 19' and 20, 20' which are constantly biased in opposite directions towards the ends of the segments 13 and 14 by two springs 21 and 22. The diameters of the balls 19, 19' and 20, 20' are sized such that, in their rest position, the balls will wedge between the ends of the camming surfaces 218, 218' and the inner wall of the case 17.

The device just described operates as follows.

With the parts in the positions illustrated by FIG. 8, any attempt at rotating the driven shaft 8 in either direction would be defeated by the balls 19, 19' and 20, 20' wedging themselves between the surfaces 218, 218' and the inner wall of the case 17. A rotation of the drive shaft 2 will drive the elements 13 and 14 through a fraction of their stroke equivalent to the backlash angle alpha, whereby the ends of the elements are caused to act on two diametrically opposed balls, e.g. balls 19' and 20 when the shaft 2 is turned counterclockwise, and pry them out of the angle between the wall of the case 17 and the corresponding surface 218, 218' of element 18, thus enabling the shaft 2 to transfer rotary motion to the element 18 through the teeth 15 and 16, and thence to the driven shaft 8. On relieving the shaft 2 of the force applied, the device will be restored automatically to its locked condition by the action from the springs 21 and 22.

It is understood that the invention is not limited to the embodiments described and illustrated. As an example, the balls 19, 19' and 20, 20' could be replaced with some other rolling members, such as rollers.

Figure 10:
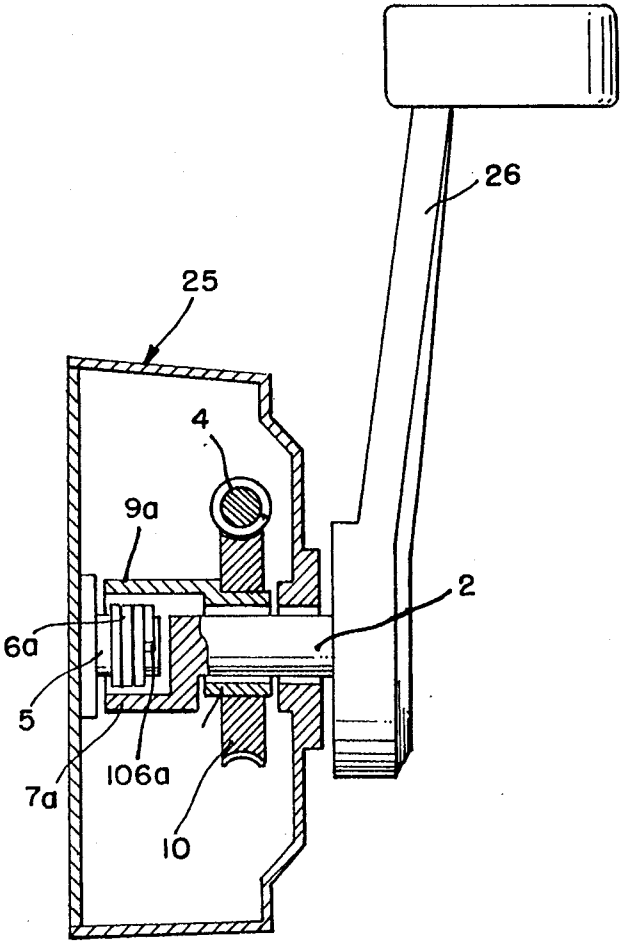
FIG. 10 is a cross-sectional view through the control box shown in FIG. 9, as equipped with the safety device of this invention.
Figure 9:
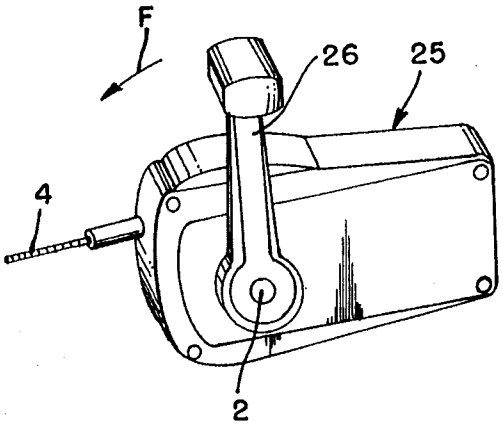
FIG. 9 is a perspective view of a dual-action, single lever control box providing control of the speed and reverse gear of a water vehicle powerplant and incorporating the safety device of this invention.

With reference to FIGS. 9 and 10, the safety device of this invention will be discussed hereinbelow as applied to a throttle control and reverse gear control for a water vehicle.

Shown in FIG. 9 is a remote control box 25 of the single lever 26 type as commonly employed to control the speed and direction of boats powered with outboard motors, or inboard engines, or inboard/outboard units equipped with hydraulically operated reverse gears.

As best shown in FIG. 10, the control lever 26 is keyed to one end of the actuating shaft 2 relating to the safety device shown in FIGS. 2A, 3A, and 4A. The safety device could be obviously embodied alternatively as shown in FIGS. 2B, 3B and 4B and as shown in FIGS. 5 through 8.

The operation of the device shown is self-evident. By moving the lever 26 in the direction of the arrow F in FIG. 9, for example, shape **7*a* is rotated in a counterclockwise direction through the shaft 2. During a first fractional rotation corresponding to angle alpha in FIG. 4A, shape 7*a* is brought to bear onto the planar surface of end 106*a* of spring 6*a*, and repel this spring end in the opposite direction from the winding direction of the spring 6*a* around the pin 5. This results in the turns of the spring 6*a* being expanded and the frictional engagement of the spring 6*a* and the shaft 5 being consequently released, whereby the spring 6*a* is allowed to rotate together with the shaft 2 of the lever 26. Concurrently therewith, the tooth 107*a* on shape 7*a* comes to bear on the shape 9*a* unitary with shaft 8, whereby the shaft 8 will be also driven rotatively by the shaft 2 of the lever 26, resulting in rotation of the pinion gear 10 which operates the cable 4** wherethrough the engine throttle control can be adjusted.

A similar effect occurs when the lever 26 is moved in the opposite direction, in which case shape **7*a* will engage the other end 206*a* of the spring 6*a* and the tooth 207 on shape 7*a* will abut against shape 9*a*. On releasing the control lever 26, the spring 6*a* will return to its original condition of close adhesion to the pin 5**, thus locking the control system securely on the selected setting therefor and preventing all possibilities of the control system from being operated unintentionally and accidentally.

Of course, with respect to operation of FIGS. 2B, 3B and 4B, opposing planar surfaces of the rectangular coil spring ends **106*b*, 206*b* will act on and be acted on by planar surfaces of the half-cups 7*b* and 9*b*** as described above.

More generally, the actuating member and actuated member may be any elements in an upstream or downstream location, respectively, in the path of movement of a water vehicle helm and throttle/direction controls.

Figure 11:
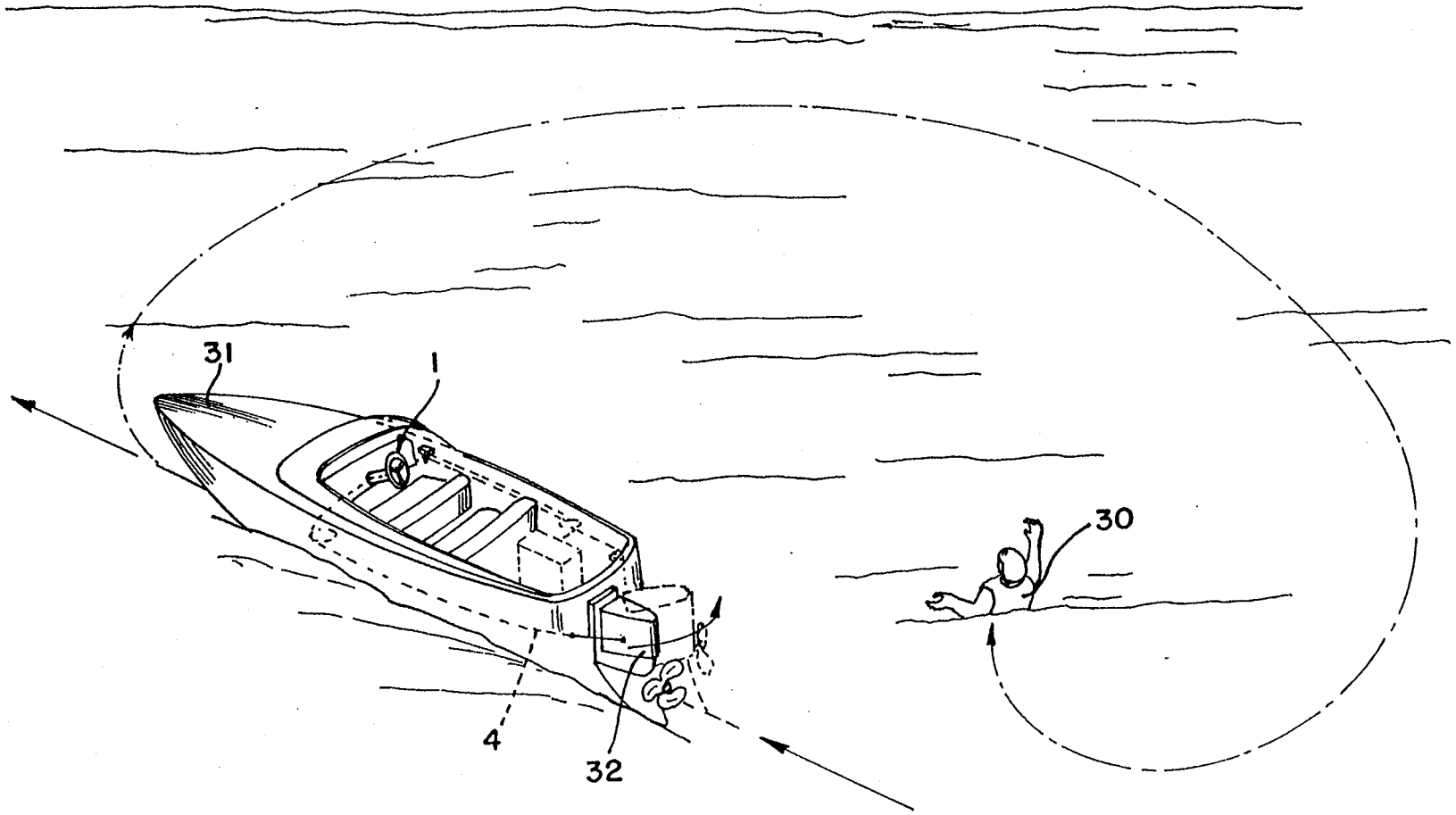
FIG. 11 depicts an applicative situation of the safety device according to the invention.

Depicted in FIG. 11 is a situation where a helmsman, shown at 30, has fallen overboard from a water vehicle, shown at 31, having its helm or steering system equipped with a safety device according to the invention. As shown in full lines, the water vehicle 31, presently with no one at the helm, will keep running in the same (straight, in the example) direction of its course before the helmsman fell overboard, since the steering device 32 of the water vehicle is locked by the inventive safety device in the same position as before the incident. Absent the safety device of this invention, the water flow around the steering device 32 would gradually bring the steering device to a position of tightest turn of the boat, whereby the boat would close in toward the man in the water along a spiral course and endanger his safety.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A safety device for small craft helm, throttle and directional controls, intended for operation between a rotatable control drive shaft and a rotatable driven shaft of the helm, throttle and directional controls comprising:

a one-way mechanical coupling for rotatively coupling the drive shaft and the driven shaft together, said one-way mechanical coupling including a first engaging element rigidly connected to the drive shaft and a second engaging element rigidly connected to the driven shaft, the first and second engaging elements being coaxially mounted and substantially geometrically matched with respect to each other for transmitting motion in a direction of rotation from said drive shaft to said driven shaft;

locking means, interposed between said first and second engaging elements, for preventing rotation from the driven shaft to the drive shaft, said locking means locking the second engaging element connected to the driven shaft and being unlocked by moving the first engaging element connected to the drive shaft against said locking means, said locking means including a rectangular coil spring frictionally engaged with a stationary portion of the device with ends of said rectangular spring oriented radially with respect to a coil portion of the spring, wherein the ends of the spring include opposing planar surfaces corresponding to the rectangular shape thereof;

means associated with said driven shaft and in abutment with ends of said spring and against a planar surface thereof for resisting rotation of said drive shaft;

first means associated with said drive shaft and adapted to cooperate with the ends of said spring and against an opposing planar surface thereof for at least decreasing the frictional engagement of said spring with said stationary portion; and second means associated with said drive shaft for rotatively entraining said driven shaft after said first means has released said driven shaft from a locked position.

2. The safety device according to claim 1, wherein said rectangular coil spring is mounted to said element associated with a stationary portion of the device such that the action from said means associated with the driven shaft on the planar surfaces of the ends of said coil spring enhances the frictional engagement with the element secured on said stationary portion, whereas the action from said first means associated with the drive shaft on the opposing planar surfaces of the ends of said coil spring results in said engagement becoming attenuated or released altogether.

3. The safety device according to claim 1, wherein said second and first means associated with said driven and drive shafts, respectively, comprise half-cup shapes of equal radius which are coaxial with said shafts and extend circumferentially each through a smaller angle than 180°.

4. The safety device according to claim 3, wherein said second means associated with the drive shaft comprises teeth which extend circumferentially on either side of the half-cup shape associated with the drive shaft at locations free of interference with said ends of said springs, the angle formed by said teeth being 180°.

5. The safety device according to claim 1, wherein said drive shaft is connected to a steering wheel of the small craft and said driven shaft is coupled to a control cable of the small craft helm.

6. The safety device according to claim 1, wherein said drive shaft is connected to a throttle and/or reverse gear control lever for a powerplant of the small craft, and said driven shaft is coupled to a throttle and/or reverse gear control cable.

7. The safety device according to claim 1, wherein said coil spring is contracted by tightly winding it around an element consisting of a pin affixed to a stationary portion of the device, with ends of said coil spring being bent radially outwards for abutment against said first means associated with said drive shaft.

8. The safety device according to claim 1, wherein said drive shaft is connected to a throttle and/or reverse gear control lever for a powerplant of the small craft, and said driven shaft is coupled to a throttle and/or reverse gear control cable.

9. A safety device for small craft helm, throttle and directional controls, intended for operation between a rotatable control drive shaft and a rotatable driven shaft of the helm, throttle and directional controls comprising:

a one-way mechanical coupling for rotatively coupling the drive shaft and the driven shaft together, said one-way mechanical coupling including a first engaging element rigidly connected to the drive shaft and a second engaging element rigidly connected to the driven shaft, the first and second engaging elements being coaxially mounted and substantially geometrically matched with respect to each other for transmitting motion in a direction of rotation from said drive shaft to said driven shaft;

locking means, interposed between said first and second engaging elements, for preventing rotation from the driven shaft to the drive shaft, said locking means locking the second engaging element connected to the driven shaft and being unlocked by moving the first engaging element connected to the drive shaft against said locking means, said locking means including a rectangular coil spring frictionally engaged with a stationary portion of the device with ends of said rectangular spring oriented radially with respect to a coil portion of the spring, wherein the ends of the spring include opposing planar surfaces corresponding to the rectangular shape thereof;

means associated with said driven shaft and in abutment with ends of said spring for resisting rotation of said drive shaft;

first means associated with said drive shaft and adapted to cooperate with the ends of said spring and against a first planar surface thereof for at least decreasing the frictional engagement of said spring and against an opposing second planar surface thereof with said stationary portion; and second means associated with said drive shaft for rotatively entraining said driven shaft after said first means has released said driven shaft from a locked position, wherein said rectangular coil spring is compressed into clutching engagement with inner walls of an element consisting of a surrounding bush secured on a stationary portion of the device, the ends of said spring being bent radially inwards to abut the first planar surface against said means associated with the driven shaft and be engaged on the second opposing planar surface by said first means associated with the drive shaft.

10. The safety device according to claim 9, wherein said rectangular coil spring is mounted to said element associated with a stationary portion of the device such that the action from said means associated with the driven shaft on the planar surfaces of the ends of said coil spring enhances the frictional engagement with the element secured on said stationary portion, whereas the action from said first means associated with the drive shaft on the opposing planar surfaces of the ends of said coil spring results in said engagement becoming attenuated or released altogether.

11. The safety device according to claim 9, wherein said second and first means associated with said driven and drive shafts respectively, comprise half-cup shapes of equal radius which are coaxial with said shafts and extend circumferentially each through a smaller angle than 180°.

12. The safety device according to claim 11, wherein said second means associated with the drive shaft comprises teeth which extend circumferentially on either side of the half-cup shape associated with the drive shaft at locations free of interference with said ends of said springs, the angle formed by said teeth being 180°.

13. The safety device according to claim 9, wherein said drive shaft is connected to a steering wheel of the small craft and said driven shaft is coupled to a control cable of the small craft helm.

14. The safety device according to claim 9, wherein said drive shaft is connected to a throttle and/or reverse gear control lever for a powerplant of the small craft, and said driven shaft is coupled to a throttle and/or reverse gear control cable.

15. The safety device according to claim 9, wherein said drive shaft is connected to a steering wheel of the small craft and said driven shaft is coupled to a control cable of the small craft helm.

16. A safety device for small craft helm, throttle and directional controls, intended for operation between a rotatable control drive shaft and a rotatable driven shaft of the helm, throttle and directional controls comprising:

a one-way mechanical coupling for rotatively coupling the drive shaft and the driven shaft together, said one-way mechanical coupling including a first engaging element rigidly connected to the drive shaft and a second engaging element rigidly connected to the driven shaft, the first and second engaging elements being coaxially mounted and substantially geometrically matched with respect to each other for transmitting motion in a direction of rotation from said drive shaft to said driven shaft;

locking means, interposed between said first and second engaging elements for preventing rotation from the driven shaft to the drive shaft, said locking means locking the second engaging element connected to the driven shaft and being unlocked by moving the first engaging element connected to the drive shaft against said locking means, said locking means including a rectangular coil spring frictionally engaged with a stationary portion of the device with ends of said rectangular spring oriented radially with respect to a coil portion of the spring, wherein the ends of the spring include opposing planar surfaces corresponding to the rectangular shape thereof;

resisting means, associated with said driven shaft and selectively abutting with a first planar surface of each end of the spring, for resisting rotation of the drive shaft; and pushing means, associated with said drive shaft and adapted to selectively abut with a second planar surface of each end of the spring, for at least decreasing the frictional engagement of said spring with said stationary portion;

wherein the first planar surface of the end of the spring, when pushed into abutment with said resisting means by said pushing means, will rotatively entrain said driven shaft after said pushing means has released said driven shaft from a locked position.

* * * * *